United States Patent [19]

Weihrauch

[11] Patent Number: 4,804,232

[45] Date of Patent: Feb. 14, 1989

[54] PROCESS AND APPARATUS FOR PRODUCING BRISTLE TUFT MATERIAL AND SINGLE BRISTLES FROM SYNTHETIC RESIN

[75] Inventor: Georg Weihrauch, Waldmichelbach, Fed. Rep. of Germany

[73] Assignee: Pedex & Co. GmbH, Fed. Rep. of Germany

[21] Appl. No.: 464,857

[22] Filed: Feb. 8, 1983

[30] Foreign Application Priority Data

Feb. 17, 1982 [DE] Fed. Rep. of Germany ..... 3205641

[51] Int. Cl.[4] ..... A46D 1/00

[52] U.S. Cl. ..... 300/21

[58] Field of Search ..... 300/1, 21; 242/42

[56] References Cited

U.S. PATENT DOCUMENTS 2,317,401 4/1943 Penn-Gaskill Hall et al. ..... 300/21

*Primary Examiner*—P. W. Echols

*Assistant Examiner*—Joseph M. Gorski

[57] ABSTRACT

In a process for producing bristle tuft material or separate bristles of plastic or synthetic resin for making sweeping brushes, brooms or housepainters' and artists' brushes, endless monofilaments are extruded and then directly wound on a bobbin or guided together in the form of tow, such tow then being twisted and cross wound onto a bobbin without end flanges so that, for a given diameter or size of bobbin, the material is less sharply bent, and will be less permanently curled when taken off the bobbin. Furthermore it is possible for a much greater length of endless monofilament material to be put in a single package so that less of the weight of such a package is made up by the weight of the bobbin. From the point of view of production engineering, there is the useful effect that the monofilaments or the twisted tow may be run off parallel to the axis of the cross wound package and the drawing off part of the brush making machine made of simpler design.

8 Claims, 2 Drawing Sheets

Figure 1:
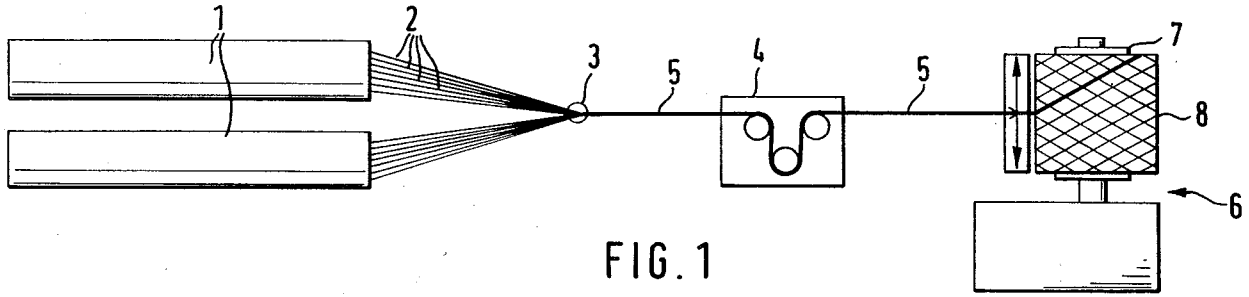

PROCESS AND APPARATUS FOR PRODUCING BRISTLE TUFT MATERIAL AND SINGLE BRISTLES FROM SYNTHETIC RESIN

BACKGROUND OF THE INVENTION

The present invention is with respect to a process and apparatus for making tufts of bristles or single bristles of synthetic resin for brushes, brooms, paintbrushes and the like by producing endless monofilament elements and then winding them directly on a bobbin or guiding them together in groups so that each group has a number of elements equal to the number of bristles in each tuft in the head of the brushes to be produced or part thereof, twisting the group of bristles so produced and winding it on a bobbin, from which the monofilament elements are let off smoothly or in steps and cut to the bristle length and before this or after this each single bristle or each bristle tuft is fixed in position on a brush head.

It is a long time since any important technical developments have been made in the brush, broom and paintbrush making industry. In quite the same way as in the processing of natural bristles, man-made bristles have firstly to be made up into tufts (that is to say if they are not to be fixed in position separately), each such tuft having desired number of bristles therein. These bristle tufts are then fixed in the body or head of the sweeping brush, broom or paintbrush, for example by wedging in place, by using adhesive, by welding (in the case of man-made bristles), by cementing or the like, man-made bristles offering the useful effect from the point of view of production engineering that they may be made as endless monofilament elements by extrusion or melt spinning. The monofilament elements are then guided together as tuft tow, which is packed in paper or metal foil and cut down to the desired length of bristle.

Before such tuft material is able to be used by a maker of sweeping brushes or paintbrushes it has to be unpacked and be placed one piece at a time into the magazine of the machine for making such brushes. While it is in fact true that by using man-made bristle materials brushes may be made more cheaply and simply than when they are made with natural bristles, the manufacturing operation is nevertheless complex. In point of fact—dependent on the sort of process used—about 15 to 30% of the working time of a machine minder is taken up with keeping a machine supplied with bristles.

For some time now attempts have been made at using endless bristle material directly for supplying a brush making machine and doing without the complex steps noted. In such attempts the bristle producer makes an endless tuft of endless monofilament elements that are twisted and wound up on a flanged bobbin so as to be parallel, the twisting operation stopping any later forming of hanging, loose loops. The flanged bobbin is then sent to the brush producer whose brush making machines will have a support for the flanged bobbins, the tuft tow being pulled off from the bobbin roughly tangentially and in steps and run to a cutter for cutting the tuft tow down to the desired bristle length. The cut-off lengths of tow then make their way directly to the wedging tools for fixing the tuft material in the head of the brush. A number of different machines have been designed that are able to be run on such endless tuft material without however coming into anything like wide use in the industry.

Processes on these lines or of generally the same sort have the shortcoming that, if the bobbins are made with a reasonable size and a weight such that they may be readily handled without their diameter being greater than a certain limit only a relatively small amount of bristle material may be stored and transported thereon. The outcome of this is that the tuft tow made up of the monofilaments has to be coiled with a generally small radius, that is to say sharply bent, more specially on the inner part of the flanged bobbin. However because of the low creep resistance of synthetic resins in general and more specially of the resins or plastics used for making bristles, if the bobbin is stored for a long stretch of time the material will be permanently bent or curled, and this will not be overcome by the resilience of the bristle material. It is hardly possible for the bristles to be changed back into their straight form again. This being the case, the material is only able to be kept wound on such bobbins for a short time.

GENERAL OUTLINE OF THE INVENTION

One purpose or object of the present invention is that of designing a process and apparatus of the sort noted which is such that the effect of the lower creep resistance of the synthetic resin is decreased and even after long storing times the bristles are still in a first rate condition.

For effecting this and further purposes in the present invention the monofilaments or the twisted tuft tow is wound in a cross winding process.

In the cross winding process the monofilaments or the twisted tow are coiled in the round-the-bobbin direction but at an adjustable helical angle on a bobbin core so that the bending of the bristle tuft tow or of the monofilament elements may be greatly decreased, and this without making the bobbin used any larger so as to be greater in size than a parallel-wound bobbin. Even if, because of creep, the material is not able to be stretched out straight again, it is not responsible for any undesired effects on later processing of the tuft tow or bristles, this being because after cutting to length the bristles will be so short that they seem to be more or less straight.

However there is in addition to this a still further important useful effect given by the invention inasfar as simple sleeve-like cores or core tubes without flanges may be used in view of the fact that cross winding is so undertaken that there is no danger of the winding layers slipping off the ends of the core. On the other hand, up till now, only flanged bobbins have been so far used for winding endless bristle material. The core of the bobbin, that in its simplest possible form may take the form of a cardboard sleeve, has a very much lower weight than a bobbin with flanges so that the relation between the bobbin weight and the overall weight of the package. This being so, it is possible for the material and transport costs to be greatly decreased, and on this point it has been seen from case studies under working conditions that the bobbin costs may be cut down to one third of the level if core bobbins are used in place of normal bobbins with end flanges, while on the other hand up to eight times more bristle material (by weight) may be taken up on such bobbins than is the case with normal bobbins having end flanges. At one and the same time there is furthermore a great saving in the space needed for such flangeless bobbins in comparison with flanged ones, this effect being more specially important in connection with the transport of the empty bobbins. A still further saving in space may be had if the bobbins are conical.

A cross-wound package may furthermore be produced without using any core or pirn. In this case, that is to say when self-supporting cross-wound packages are used, there is no need for any bobbin at all and the savings in costs in connection with storing and transporting the material are in fact even greater.

Because the tuft material packages are larger in size, that is to say, they have more material in them the machines used for producing the bristle material and for unwinding such material in the brush making works may be kept running for a long time before they have to be stopped for changing over from package to the next one.

In the process of the present invention the winding operation is best so undertaken that the twisted tuft material is first wound parallel on one or more product bobbins, from which it is then later run off and cross wound. It is for this reason that it is now possible for the production of the tuft tow on the one hand and the cross winding operation on the other to be kept separate from each other insofar as the parallel-wound package may be used as a sort of buffer or accumulator. Because of this it is now possible for more than one tuft tow to be unwound from its produce package and with other lengths of such tow or sliver to be wound onto a single core in a cross winding operation if needed.

In addition to this, the present invention is responsible for making further technical headway in the brush and broom making art inasfar as the tuft tow or the tuft tows or monofilaments may be run off from the cross wound package in the direction of the axis of the package for further processing, this being different to the normal way of taking the material from the package in steps and in a tangential direction so that the tuft tow or the single bristles is not taken off smoothly but in stops and starts, something which in turn makes necessary a relatively complex driving system for running off the material from the packages and for supporting the packages and keeping them in place. It is not hard to see that the present invention is quite different in this respect inasfar as it is now possible for the tuft tow or the separate bristle material or be pulled off in the direction of the package winding axis or parallel thereto; this is something making for a simpler design of the package or cheese support and the system for taking the material therefrom.

For using the process the invention takes as a starting point an apparatus (as used in the art for making a tow of bristle material) made up of one or more production lines for the extrusion of endless monofilament, a unit for guiding the monofilaments together into a single tuft tow and for twisting the same together, there being a package support for winding up such tuft tow. If the apparatus is to be run on monofilament, there will however be no need for the unit for guiding the separate monofilaments together to make a single tow of tuft material and for twisting same. A further point is that in this case it is not necessary to have a bobbin support on the machine inasfar as it is possible for monofilaments to be cross wound straight onto a package core. Apparatus in keeping with the present invention is designed with a cross winder for the twisted tuft tow or the monofilaments, an intake unit of said cross winder, and a large-diameter flangeless package core for the cross wound package, this furthermore making possible the production of a self-supporting cross-wound package without a package core.

The separate parts of the apparatus, as for example the twisting unit, the cross winding machine with its intake unit, the flangeless, straight or cone-like package cores and systems for winding without any such core may be of known design so that no detailed account thereof will be necessary in the present connection.

A useful further development of the invention may be made by the addition of a package support coming after the twisting unit, such support being used for producing a parallel wound package so that such a parallel wound package may then, when completed, be forwarded to the intake part of the cross winding machine. With such a system it is then possible for the production of the endless monofilaments and the production of the cross wound packages to take place at different points and at different times so that the production engineering side of the apparatus is more straightforward in more than one respect.

As for the further processing of the cross wound packages, the starting point of the invention is a known brush or broom making machine having one or more supports for packages, draw-off parts for the tuft material tow or the monofilaments and a cutter unit for cutting the material down to the desired lengths. In keeping with the present invention such a machine is then so designed that the support or supports is or are, whichever is the case, designed for use with bobbin cores or for self-supporting cross wound packages and the draw-off unit is roughly lined up with the axis of the bobbin core or the axis of the cross wound package or is parallel to such axis.

These further parts of the system of the invention may each be of known design so that once again no detailed account thereof is necessary herein.

On taking a general view of the process and apparatus of the present invention it will be seen that makes possible fully automated production or at least is a great step forward in this direction.

Further useful effects and details of the invention will be seen from the account now to be given of some working examples thereof using the figures herein.

LIST OF THE VIEWS OF THE FIGURES

FIG. 1 is a diagrammatic view of one form of the invention for producing a cross wound package of monofilament.

Figure 2A:
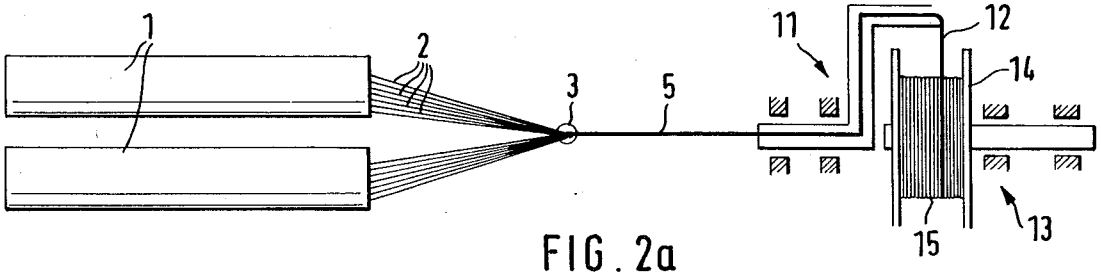

FIG. 2*a* is a diagrammatic view a system for producing monofilament by extrusion, forming it into a tow and twisting and winding the tow.

Figure 2B:
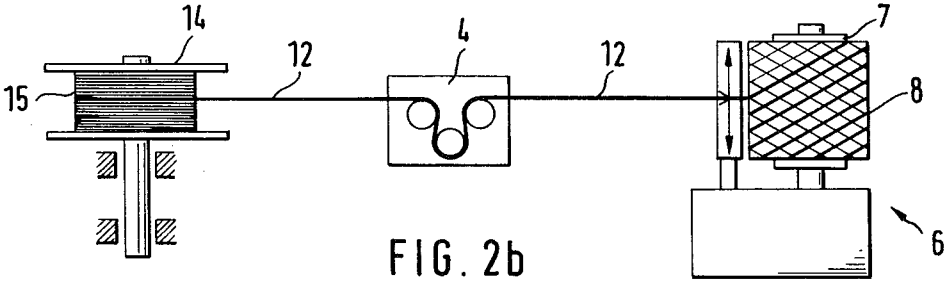

FIG. 2*b* is a diagrammatic view of a system for cross winding such tow.

Figure 2C:
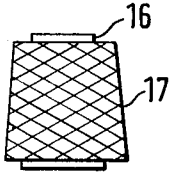

FIG. 2*c* is a view of a conical tuft tow or sliver package from the side.

Figure 3:
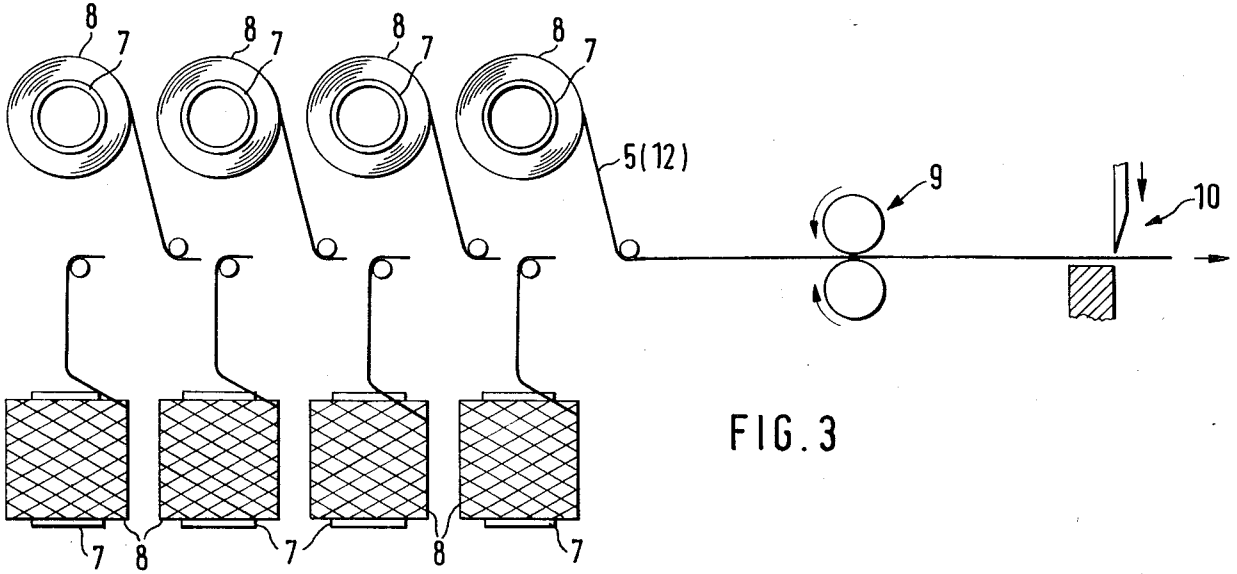

FIG. 3 is a diagrammatic view of an apparatus for further processing of cross wound material.

DETAILED ACCOUNT OF WORKING EXAMPLES OF THE INVENTION

Turning now more specially to FIG. 1 it will be seen that there are a number of extruders 1 for producing a number of monofilament endless bristles 2, that is to say endless bristle material that is later to be cut down to the length needed. The monofilaments are guided together at 3 to a single point in the form of a length of tow 5. The same is pulled into the intake 4 of a cross winding machine 6, that in the present example of the invention has a cylindrical package core 7 on it for the tow of monofilaments to be wound up as a cylindrical cross wound package 8.

On the intake side of a machine for producing brushes, such as brushes or brooms for sweeping, or paintbrushes, there is the system to be seen in FIG. 3. As will be seen from the top left part of this figure the machine may have a number of level shafts supported in bearings on which the package core tubes or cores 7 or the cross wound packages are placed on the level or, as may be seen on the lower left in the FIG. 3, there may be a number of upright spindles for supporting the package core tubes 7 or the cross wound packages in upright positions. On the outlet side of this support part for the package tubes 7 there is a draw-off unit 9 for pulling off the monofilament tow from the package core tubes 7, the direction of draw-off being generally tangential if the package tubes 7 are supported in level position, while on the other hand if they are upright, the direction of draw-off will be generally parallel with the axis of the cross wound package. On the outlet side of the draw-off unit 9 there is a cutter 10 for cutting the monofilament tow down to the right bristle length in separate cutting motions. It will then be possible for the separate bristles to be fixed in the head or body of a brush, such as a sweeping brush, a broom, a paintbrush or the like in a machine coming after the cutter 10.

In the form of the invention viewed in FIG. 2*a* a twisted bristle tuft tow or sliver is produced and to this end the endless monofilaments 2 coming from the extruders 1 are run to a guide at a point at 3 putting them together as one single tow 5 in which they are parallel. Such tow then goes on further to a twisting unit 11 whose output in the form of a twisted tow 12 or sliver is wound up parallel on a bobbin support 13 bearing a flanged bobbin 14 as a parallel wound package 15.

After this the twisted tuft tow 12 is pulled off the parallel wound package 15 on the flanged bobbin 14 by way of the intake 4 of a cross winding machine 6. If necessary the bobbin is put in an upright position for this. The cross winding machine 6 as well has a cylindrical package tube 7 of large diameter on which a cross wound package is produced from the tuft tow 12 as a self-supporting body. In place of the cylindrical package core it is possible to have (see FIG. 2c) a cone 16 so that a cone-like cross wound package 17 is the outcome. The cross wound packages in the forms 8 or 17 are then further processed in the way noted in connection with FIG. 3 so that at the outlet end of the cutter 10 one will have separate lengths of bristle tuft or single bristles which are somewhat twisted.

While a detailed account of some forms of the invention has been given, it will be clear that this is not for the purpose of limiting the idea of the invention, and many changes therein will be possible for those versed in the art. As an example of one such possible change, the monofilament material may be cross wound separately so that herein the word "tow" is used in the sense of a single length of monofilament as well, although in most cases there will be a number of filaments in such tow.

I claim:

1. A process for producing a brush having at least one tuft of bristles fixed into a head thereof comprising the steps of producing endless monofilaments from a synthetic material having a low creep resistance, forming said monofilaments into a tow or sliver having a number of monofilaments, the number of monofilaments in such tow being equal to at least part of the number of bristles desired in such tuft of bristles in the brush, twisting said tow, cross winding said tow after twisting to minimize bending and permanent curl of the monofilaments and produce a cross wound tow package, and furthermore using said cross wound tow in brush making operations for producing said brush having at least said one bristle tuft fixed therein with the bristles cut to a desired length.

2. The process as claimed in claim 1 wherein said twisted tow is parallel wound as a parallel wound tuft tow package, from which said tow is unwound and then cross wound as said cross wound package.

3. The process as claimed in claim 1 wherein at least two such tows are put together and cross wound to give said cross wound package of tuft tow.

4. The process as claimed in claim 1 wherein the tow is run off from the cross wound package in a direction parallel to an axis of said package and then used in said brush making operations.

5. The process as claimed in claim 1 wherein said tuft tow is taken off said cross wound package in steps, the package being stopped and started therefor.

6. The process as claimed in claim 1 wherein said tow is taken off said cross wound package smoothly and at an unchanging speed.

7. The process as claimed in claim 1 wherein in said brush making operations said tuft tow, after unwinding the same from said cross wound package, is first cut to length and then fixed in said brush head.

8. A process for producing a brush from a material of low creep resistance the brush having tufts with at least one bristle in each tuft, said material being formed into a tow made up of at least one bristle fiber, comprising the steps of producing at least one endless monofilament from the material, forming said monofilament into a tow having a number of monofilaments, the number of monofilaments in such tow being equal to at least part of the number of bristles desired in such tuft of bristles in said brush, twisting said tow, and cross winding said tow after twisting to minimize bending and permanent curl of the monofilaments and provide a cross wound package of tuft tow for use in making the brush

* * * * *